US005477981A

United States Patent [19]

Heyl et al.

[11] Patent Number: 5,477,981

[45] Date of Patent: Dec. 26, 1995

[54] TWIST ARTICLE DISPENSER

[75] Inventors: Pamela Heyl, Bedminster, N.J.; Rodney Gayle, Wilmington, Del.; Gregg Gayle; Harold R. Gayle, both of Bear, Del.

[73] Assignee: Excerpta Medica, Inc., Belle Mead, N.J.

[21] Appl. No.: 231,506

[22] Filed: Apr. 22, 1994

[51] Int. Cl.[6] ..... G07F 11/00

[52] U.S. Cl. ..... 221/86; 221/89; 206/533

[58] Field of Search ..... 221/82, 91, 86, 221/89, 5, 103, 277, 191, 194; 206/533, 534, 538

[56] References Cited

U.S. PATENT DOCUMENTS

| | | | |
|---|---|---|---|
| 2,943,730 | 7/1960 | Tregilgas | 206/534 |
| 3,570,707 | 3/1971 | Finkel | 221/5 |
| 3,744,672 | 7/1973 | Dangles et al. | 221/82 |
| 3,926,335 | 12/1975 | Dangles et al. | 221/82 |
| 4,117,952 | 10/1978 | Grimes | 221/5 |
| 4,128,188 | 12/1978 | White | 221/91 |
| 5,000,343 | 3/1991 | Allen | 221/89 |

FOREIGN PATENT DOCUMENTS

| | | | |
|---|---|---|---|
| 2186269 | 8/1987 | United Kingdom | 221/86 |

*Primary Examiner*—Kenneth Noland

*Attorney, Agent, or Firm*—Finnegan, Henderson, Farabow, Garrett & Dunner

[57] ABSTRACT

Dispenser for selectively dispensing contents includes a first element having a base portion and a peripheral sidewall that defines a cavity, and a second element rotatably mounted within the cavity. A number of compartments are provided along a peripheral portion of the upper surface of the second element. Each compartment is marked by indicia, and includes a sloped bottom wall, an open top, and an open outer end facing the peripheral sidewall so the contents loaded within the dispenser are contained within the compartments by the peripheral sidewall. An outlet is formed through the peripheral sidewall, and a tray member extends from the peripheral sidewall proximate to the outlet so the contents contained within a selected compartment are dispensed onto and retained by a retaining portion of the tray member when the second element is rotated relative to the first element. A transparent cover member that is moveable between a closed position and an open position is attached to the second element by hinges.

21 Claims, 3 Drawing Sheets

TWIST ARTICLE DISPENSER

BACKGROUND OF THE INVENTION

1. Field of the Invention

The present invention relates to an article dispenser for selectively dispensing contents that are loaded within the dispenser. In particular, the present invention is directed to a convenient dispenser for dispensing pills or tablets at selected intervals by a simple twisting or rotary movement.

2. Description of the Related Art

Dispensers are presently used for selectively dispensing a variety of articles. Particularly, dispensers have proven to be an effective device for dispensing and allotting the proper dosage of pharmaceuticals and vitamin supplements that are produced in pill or tablet form.

Various pill dispensers are available to the public. For example, U.S. Pat. No. 2,943,730 issued to Tregilgas, U.S. Pat. No. 3,570,707 issued to Finkel, and U.S. Pat. No. 4,128,188 issued to White each disclose a compact, hand-held pill dispenser for discharging prescribed pharmaceuticals into the palm of a hand. Each of these pill dispensers is generally designed to be preloaded by a physician, pharmacist, or other authorized individual. Specifically, these compact pill dispensers must be loaded prior to assembly, and then disassembled by the authorized individual for each subsequent loading. These pill dispensers are not intended to be easily opened, and the sequence in which the pills are discharged must be predetermined and prescribed by the physician. Further, although each of these pills dispensers is designed for easy operation, elderly and arthritic individuals may experience difficulty in operating such hand-held devices due to their compact construction.

Alternatively, U.S. Pat. Nos. 3,744,672 and 3,926,335 issued to Dangles et al., and U.S. Pat. No. 4,117,952 issued to Grimes each disclose a pill dispenser that may be mounted on a horizontal surface. These pill dispensers are more versatile than the known compact pill dispensers because they need not be preloaded by a physician or similarly authorized individual. However, loading of the pill dispenser of Grimes requires that the pill dispenser be disassembled, while loading of each of the pill dispensers of Dangles et al. is restricted to a single compartment at a time, which may prove to be a time consuming and difficult task. Further, these pill dispensers do not enable pills or capsules to be retained at an easily accessible location once discharged from the pill dispenser.

As such, there remains a need for a versatile dispenser that is easy to operate and permits selective loading and dispensing of its contents, particularly of pills and tablets. There further remains a need for a dispenser that is inexpensive and easy to fabricate, and that remains intact during loading to avoid the misplacement of parts and the requirement of reassembly.

SUMMARY OF THE INVENTION

The advantages and purpose of the invention will be set forth in part in the description that follows, and in part will be obvious from the description, or may be learned by practice of the invention. The advantages and purpose of the invention will be realized and attained by means of the elements and combinations particularly pointed out in the appended claims.

To achieve the advantages and in accordance with the purpose of the invention, as embodied and broadly described herein, the present invention includes a dispenser for selectively dispensing contents that are loaded within the dispenser.

The dispenser of the present invention includes a first element having a base portion and a peripheral sidewall extending from the base portion to define a cavity within the first element, and a second element mounted within the cavity to be rotatable relative to the first element. The second element has a lower surface and an upper surface, and a number of compartments provided along a peripheral portion of the upper surface. Each compartment includes a pair of side walls and a bottom wall, as well as an open outer end facing the peripheral sidewall of the first element. In this manner, the contents loaded within the dispenser are generally contained within the compartments by the peripheral sidewall of the first element. Further, it is preferred that each compartment has an open top, and that the bottom wall of each compartment is sloped to slide the contents contained within the compartment toward the peripheral sidewall.

An outlet is formed through the peripheral sidewall of the first element. The outlet is configured such that a selected one of the compartments may be aligned with the outlet by rotation of the second element relative to the first element. This configuration permits the contents that are contained within the selected one compartment to be dispensed through the outlet. Preferably, the dispenser further includes positioning means for successively indexing the open outer end of each of the compartments in alignment with the outlet as the second element is rotated relative to the first element.

A tray member having a retaining portion is positioned proximate to the outlet and extends radially outward from the outer peripheral sidewall. The retaining portion is provided by forming a recess on an upper surface of the tray member. By positioning the tray member proximate to the outlet, the retaining portion of the tray member can receive and retain the contents dispensed through the outlet.

The dispenser also includes a cover member attached to the second element by at least one hinge. The cover member is movable between a closed position that substantially closes the open tops of the compartments and an open position that allows access to the compartments through the open tops for loading of the contents therein. Preferably, the cover member is transparent for visibility of the contents contained within the compartments when the cover member is in the closed position. The second element and the cover member are provided with indicia identifying each of the compartments.

It is to be understood that both the foregoing general description and the following detailed description are exemplary and explanatory only and are not restrictive to the invention, as claimed.

The accompanying drawings, which are incorporated in and constitute a part of the specification, illustrate embodiments of the invention and together with the description, serve to explain the principles of the invention.

DESCRIPTION OF THE PREFERRED EMBODIMENTS

Figure 1:
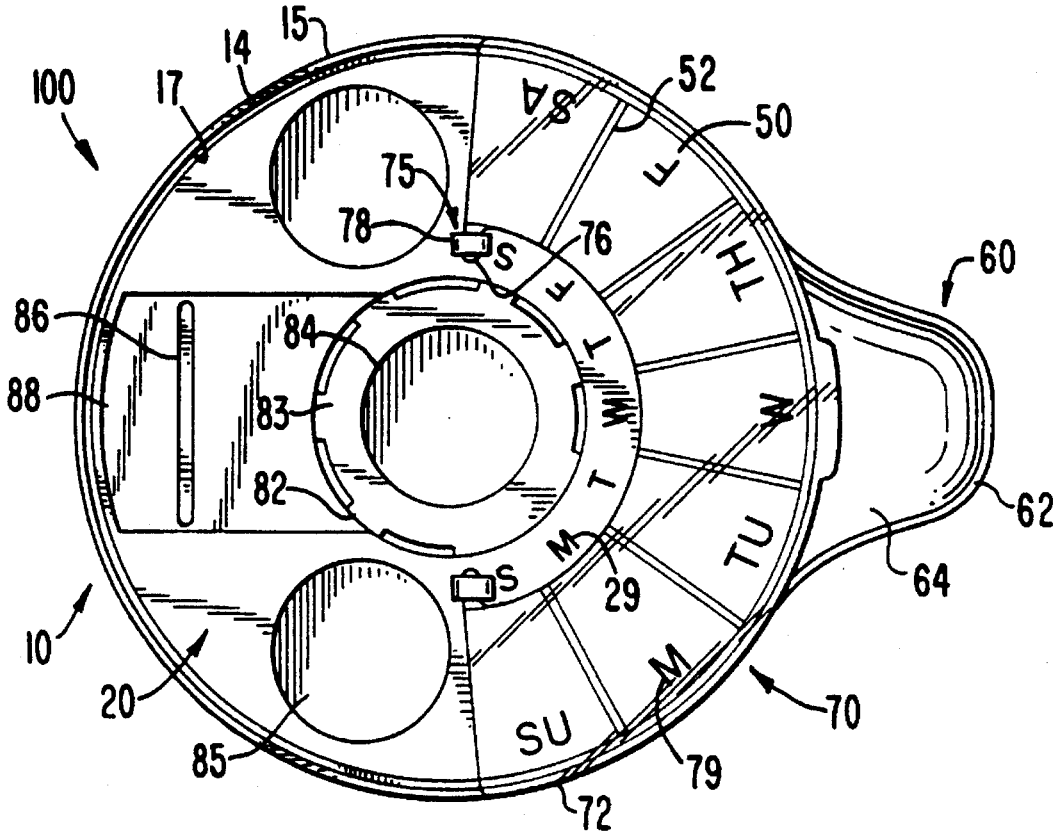
FIG. 1 is a top view of a representative embodiment of the dispenser of the present invention.

Reference will now be made in detail to a present preferred embodiment of the invention, an example of which is illustrated in the accompanying drawings. Wherever possible the same reference numbers will be used throughout the drawings to refer to the same or like parts.

The dispenser provided in accordance with the present invention generally includes a first element having a cavity and a second element mounted within the cavity to be rotatable relative to the first element. An exemplary embodiment of the dispenser is presented in FIGS. 1 through 5, and is designated generally by reference character 100.

Figure 2:
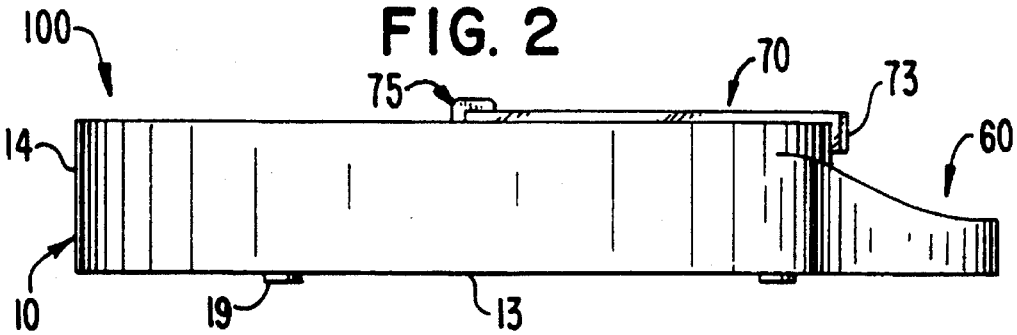
FIG. 2 is a side view of the dispenser of FIG. 1.
Figure 3:
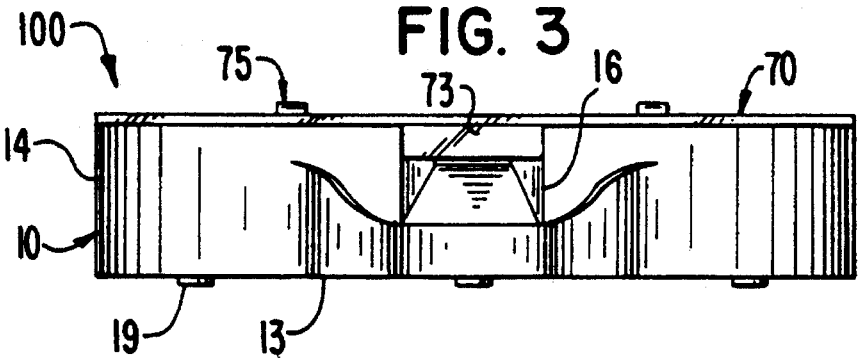
FIG. 3 is a front view of the dispenser of FIG. 1.
Figure 4:
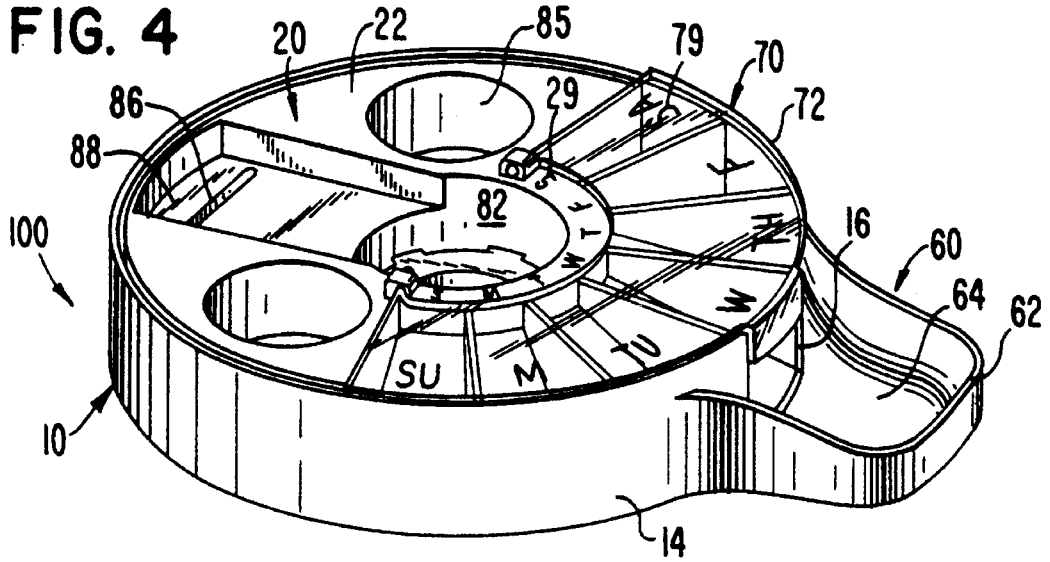
FIG. 4 is a perspective view of the dispenser of FIG. 1.
Figure 5:
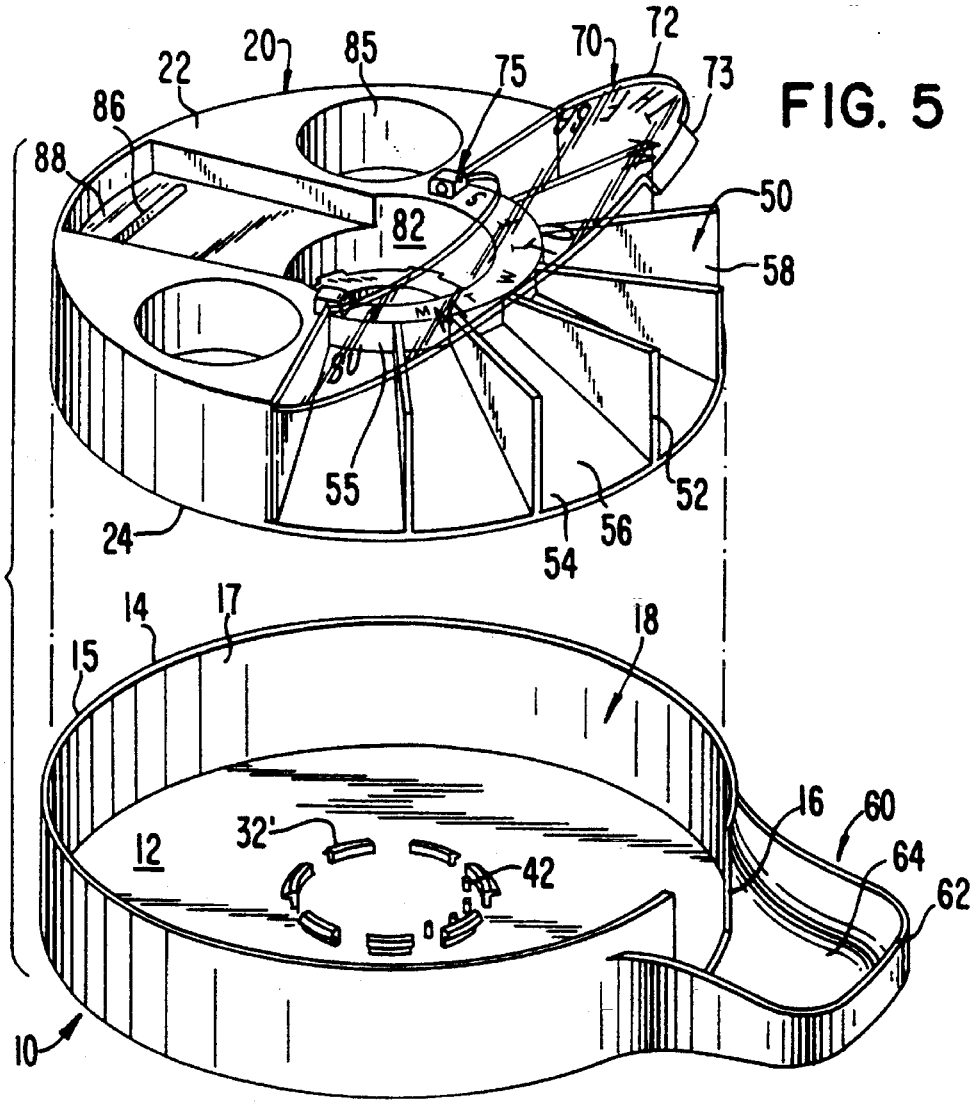
FIG. 5 is an exploded perspective view of the dispenser of FIG. 1.

With initial reference to FIGS. 1, 4, and 5, the first element 10 of the dispenser 100 embodied herein includes a base portion 12 and a peripheral sidewall 14 extending from the base portion 12 to define the cavity 18 within the first element 10. As depicted in FIGS. 2 and 3, the base portion 12 is a substantially flat member having a planar bottom 13 so as to be positionable on a support surface. However, the shape of the base portion 12 may be altered to correspond to a contoured support surface if desired. Regardless of the shape of the base portion 12, it is preferred that the bottom 13 of the base portion 12 be provided with a friction member 19, such as rubber or a similar elastomeric material, to prevent the dispenser 100 from inadvertently slipping when placed on the support surface. The friction member 19 may be formed as a single sheet or coating on the bottom 13 of the base portion 12, or as a plurality of pads, as seen in FIGS. 2 and 3. Alternatively, suction cups or adhesive may likewise be used.

In accordance with the present invention, a peripheral sidewall extends from the base portion to form a cavity in the first element. FIGS. 1, 4, and 5 depict the peripheral sidewall 14 as a continuous member extending from the entire peripheral edge of the base portion 12 to define a cavity 18 having a circular shape. That is, the base portion 12 of the exemplary embodiment is formed substantially as a disk member, while the peripheral sidewall 14 is formed substantially as a cylindrical member of uniform thickness extending from the peripheral edge of the base portion 12. In the exemplary embodiment, the sidewall extends about 1⅛ inches from the base portion to form a cavity 18 having a diameter of about 5¼ inches.

Alternatively, the thickness and the outer surface 15 of the peripheral sidewall 14 may be varied to provide the first element 10 with an alternate appearance or shape. For example, the peripheral sidewall 14 may be varied in thickness such that the overall shape of the first element 10 resembles a polyhedron, or the outer surface 15 of the peripheral sidewall 14 may be provided with a scalloped or fluted appearance. However, a smooth surface is preferred so that markings or advertisements can be provided on the outer surface 15 of the peripheral sidewall 14.

As best seen in FIGS. 1, 4, and 5, it is preferred that the cavity 18 has a circular shape, as defined by the inner surface 17 of the peripheral sidewall 14. Although FIGS. 1, 4, and 5 depict the inner surface 17 of the peripheral sidewall 14 as an uninterrupted surface, the circular shape of the cavity 18 may likewise by formed by a series of short planar segments. It is also possible to define the cavity 18 by forming the peripheral sidewall 14 as an arcuate member that only partially forms a circular shape, as will be discussed.

A variety of materials and methods may be used for fabrication of the first element 10. For example, the first element 10 of the dispenser 100 may be fabricated from virtually any durable material, including metals, plastics, polyvinyl, or similar compounds. Depending upon the material selected, the first element 10 may be fabricated by milling, casting, injection molding or any other suitable fabrication method. In the preferred embodiment of the present invention, the first element 10 is fabricated from a plastic material by injection molding. Further, although the base portion 12 and the peripheral sidewall 14 of the first element 10 may be formed separately and then attached together, it is preferred that the first element 10 be fabricated as a single piece.

As previously mentioned, and in accordance with the present invention, the dispenser also includes a second element that is mounted within the cavity to be rotatable relative to the first element. It is evident from FIG. 5 that the second element 20 of the dispenser 100 includes a lower surface 24 and an upper surface 22. The second element 20 has a substantially circular shape that corresponds with the shape and dimension of the cavity 18 defined by the peripheral sidewall 14 of the first element 10. Although FIGS. 1 and 5 depict the second element 20 with a continuous curved edge, it is noted that the substantially circular shape of the second element 20 may likewise be formed by a series of straight edge segments or similar adaptations. Rotatable mounting of the second element 20 relative to the first element 10 may be accomplished by a variety of means.

Figure 6:
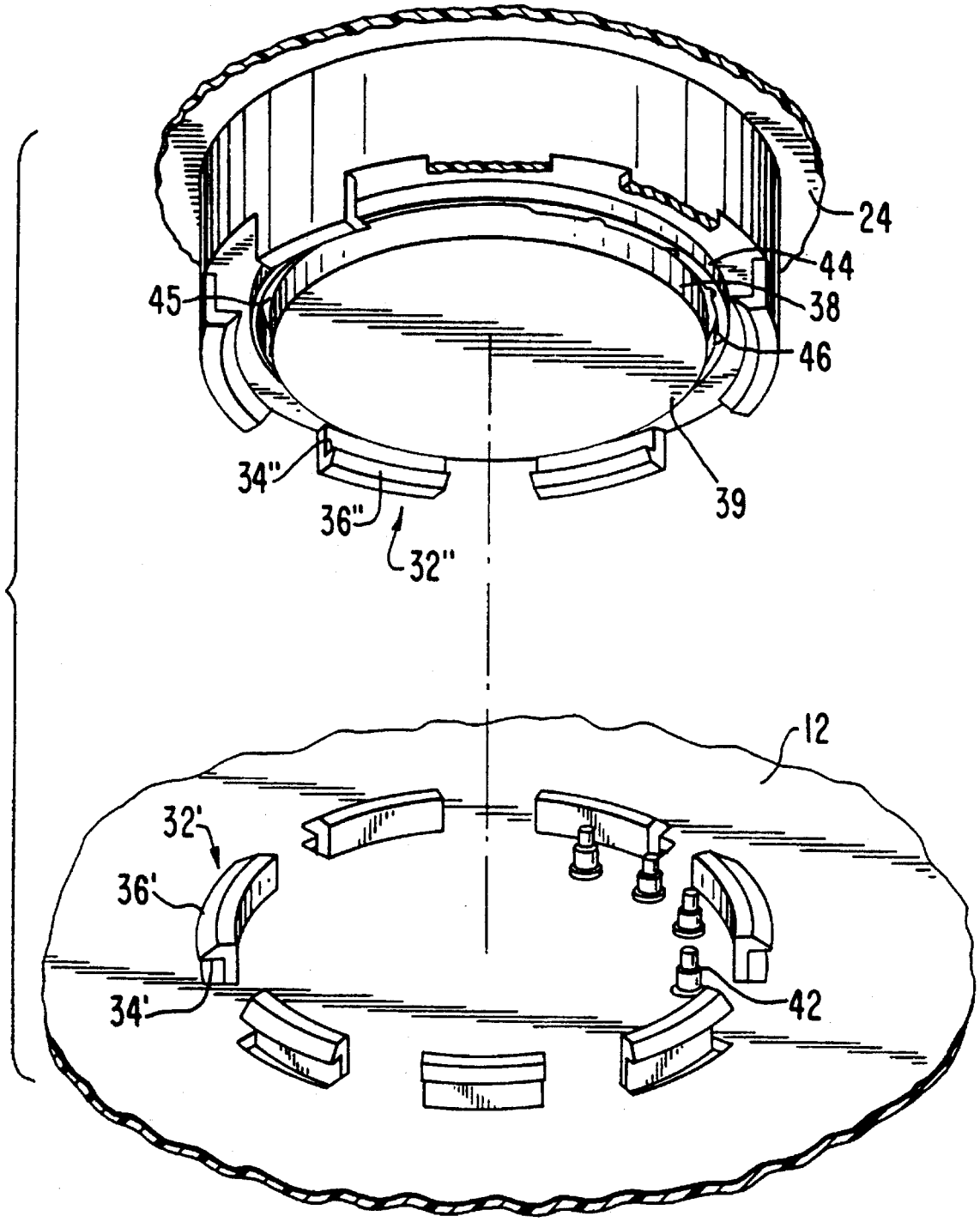
FIG. 6 is an enlarged fragmentary view of the connection partially shown in FIG. 5.

FIGS. 5 and 6 depict one exemplary embodiment of means for rotatable mounting the second element 20 within the cavity 18 of the first element 10 in accordance with the present invention. A plurality of upstanding locking members 32' are provided on the base portion 12 of the first element 10, while a plurality of corresponding depending locking members 32" are provided on the lower surface 24 of the second element 20.

The upstanding and depending locking members 32',32" each include a locking edge, such that the locking edges 34' of the upstanding locking members 32' mate with the locking edges 34" of the depending locking members 32" when the second element 20 is inserted into the cavity 18 of the first element 10. Specifically, the upstanding and the depending locking members 32',32" are made of resilient material and configured to be laterally flexible. By further providing the upstanding and depending locking members 32',32" with corresponding camming surfaces 36' 36" the laterally flexible locking members 32',32" distort slightly in the lateral direction due to the camming action of the camming surfaces 36',36" as the second element 20 is inserted into the cavity 18. Once the second element 20 is sufficiently inserted within the cavity 18, i.e., after the camming surfaces 36',36" are no longer in contact, the laterally flexible locking members 32',32" return to their original orientation and the locking surfaces of the upstanding and the depending locking members 32',32" mate to secure the second element 20 within the cavity 18. Although FIG. 6 shows that the locking edges 34',34" of the upstanding locking members 32' are directed outwardly while those of the depending locking members 32" are directed inwardly, the direction of the locking edges 34',34" may be reversed.

To facilitate relative rotation between the first and second elements 10,20, the upstanding and depending locking members 32',32" are arranged into corresponding circular configurations that are concentric with the cavity 18 and the second element 20, respectively. FIGS. 5 and 6 depict the upstanding locking members 32' arranged in a circular configuration on the base portion 12 of the first element 10 proximate the center of the cavity 18. However, the upstanding locking members 32' may also be formed along the circumference of the cavity 18, such that the upstanding locking members 32' are formed as tab formations along the peripheral sidewall 14 of the first element 10 with inwardly directed locking surfaces. Accordingly, the depending locking members 32" would be formed along the peripheral edge of the second element 20 in a skirt-like formation with outwardly directed locking surfaces.

Rotation is further enhanced by providing a support member 38 on one of the first and second elements 10,20. Preferably, the support member 38 is located at the center of the circular configurations of the upstanding and the depending locking members 32',32" so as to operate as a pivot surface for rotation of the second element 20 relative the first element 10. FIG. 6 depicts the support member 38 extending from the lower surface 24 of the second element 20. The support member 38 is cylindrical, and includes a planar end 39 to contact the base portion 12 of the first element 10. In this exemplary embodiment, it is further preferred that a conventional lubricating substance, either solid or liquid, be provided between the planar end 39 of the support member 38 and the base portion 12 of the first element 10. Alternative embodiments include locating the support member 38 on the first element 10, or providing the support member 38 with a spherical or conical end configuration to form a defined point of contact between the first and second elements 10,20.

As best seen in FIG. 5, and in accordance with the present invention, a number of compartments 50 are provided along a peripheral portion of the upper surface 22 of the second element 20. Each compartment 50 includes a pair of side walls 52 and a bottom wall 54. In the exemplary embodiment of the dispenser 100 presented herein, each compartment 50 also includes an inner end wall 55. Preferably, the side walls 52 extend radially from the approximate center of the second element 20, such that each compartment 50 is substantially wedge shaped. The angular spacing between each pair of side walls 52 about the periphery of the preferred embodiment of the second element 20, and thus between the centers of the compartments 50, is between about 20° and 25°.

Each compartment 50 further includes an open outer end 56 facing the peripheral sidewall 14 when the second element 20 is mounted within the first element 10. FIGS. 1 and 5 show that the second element 20 is dimensioned to be received by the cavity 18 in the first element 10, such that the peripheral sidewall 14 of the first element 10 effectively forms an outer wall for the compartments 50. In this manner, and as will be discussed below, the contents that are loaded within the dispenser 100 are generally contained within the compartments 50 of the dispenser 100 by the peripheral sidewall 14 of the first element 10.

To facilitate easy loading of contents into the dispenser 100, each compartment 50 embodied herein further includes an open top 58. The open top 58 and open outer end 56 of each compartment 50 may be formed as a continuous opening, as depicted in FIG. 5. Alternatively, a beam member may be provided between each pair of side walls 52 to enhance the structural rigidity of the second element 20 and to separate the open top 58 from the open outer end 56. The dispenser 100 also includes a cover member to close the open tops 58 of the compartments 50 and protect the contents contained within the compartments 50, as will be discussed.

The specific dimensions of each compartment 50, as well as the dimensions of the open top 58 and open outer end 56 of each compartment 50, are generally related to the contents intended to be dispensed by the dispenser 100. For example, in one exemplary embodiment of the dispenser 100, the overall length of each compartment 50 is approximately 1¼ inches, while the open end of each compartment 50 is approximately 1 inch wide and approximately ¾ inches high. This exemplary embodiment enables four or more pills of average size to be contained in each compartment 50.

As with the first element 10, the second element 20 of the dispenser 100 likewise may be fabricated from virtual any durable material, including metals, plastics, polyvinyl, or similar compounds. Similarly, and depending upon the material selected, fabrication of the second element 20 may be performed by milling, casting, injection molding or any other suitable fabrication method. In the preferred embodiment of the present invention, the second element 20 is also fabricated from a plastic material as a single piece by injection molding.

Further in accordance with the present invention, the peripheral sidewall of the first element includes an outlet formed therethrough. As best seen in FIG. 4, the outlet 16 is formed through the peripheral sidewall 14 at an appropriate location to permit the open end of each compartment 50 to be successively aligned with the outlet 16 as the second element 20 is rotated within the cavity 18 relative to the first element 10. Specifically, a selected one of the compartments 50 may be selectively aligned with the outlet 16 by rotation of the second element 20 relative to the first element 10. Upon loading of the dispenser 100, this configuration permits the contents that are contained within the selected one compartment 50 to be dispensed through the outlet 16, while the contents of the remaining compartments 50 are contained by the peripheral sidewall 14. Hence, and as previously mentioned, it is possible to form the peripheral sidewall 14 as an arcuate member that only partially forms a circular shape. However, the peripheral sidewall 14 should have an arcuate length at least equivalent to that of the open outer ends 56 of all of the compartments 50, so as to contain the contents of all of the compartments 50 prior to the first compartment 50 being moved into alignment with the outlet 16.

To enhance dispensing operation of the dispenser 100, the bottom wall 54 of each compartment 50 of the preferred embodiment is sloped so as to slide the contents contained within each compartment 50 toward the outer peripheral sidewall 14. In this manner, when the open end of a selected one of the compartments 50 is aligned with the outlet 16 by rotation of the second element 20 relative to the first element 10, the contents contained within the selected compartment 50 will automatically slide outwardly through the outlet 16 due to gravity. A slope angle of between about 20° and 35° has been found to be most desirable, although a wider range of slope angle is permissible. Dispensing operation is further enhanced by dimensioning the outlet 16 to be substantially similar in size to the open end of each compartment 50. This minimizes the likelihood of inadvertent or undesirable blockage of the outlet 16 by eliminating an exposed surface of the peripheral sidewall 14 within the selected compartment 50.

The dispenser 100 embodied herein also includes positioning means for successively indexing the open outer end 56 of each of the compartments 50 in alignment with the outlet 16 as the second element 20 is rotated within the cavity 18 relative to the first element 10. Although alternative positioning means may be used, the positioning means of the exemplary embodiment presented herein includes at least one protuberance 42 provided on one of the first and second elements 10,20, and a series of indentations 46 provided on the other of the first and second elements 10,20. The series of indentations 46 are configured to successively receive and engage the protuberance 42 as the second element 20 is rotated relative to the first element 10 to successively position the open outer end 56 of each compartment 50 in alignment with the outlet 16.

For example, and as best seen in FIG. 6, the exemplary embodiment of the present invention includes four rod shaped protuberances 42 integrally formed of resilient material on the base portion 12 of the first element 10, and a cylindrical structure 44 integrally formed on the lower surface 24 of the second element 20. Although the rod shaped protuberances 42 are shown having circular cross sections, polyhedron protuberances 42 likewise may be used. The rod shaped protuberances 42 are arranged along the arc of a circle that is concentric with the circular arrangement of the upstanding locking members 32', while the cylindrical structure 44 is positioned to be concentric with both the support member 38 and the circular configuration of the depending locking members 32". The cylindrical structure 44 forms an annular gap 45 between the support member 38 and the cylindrical structure 44, wherein the annular gap 45 corresponds to the arrangement of the rod shaped protuberances 42. That is, when the second element 20 is mounted within the cavity 18 of the first element 10, the rod shaped protuberances 42 are inserted into the annular gap 45.

The cylindrical structure 44 also includes a series of indentations 46 that are configured to successively receive and engage the rod shaped protuberances 42 as the second element 20 is rotated relative to the first element 10. The angular spacing between the protuberances 42 and between the indentations 46 are both equivalent to the angular spacing between the centers of the compartments 50, as discussed above. In this manner, relative rotation of the second element 20 is indexed to successively position the open outer end 56 of each compartment 50 in alignment with the outlet 16. Although FIG. 6 depicts the protuberances 42 and the cylindrical structure 44, which includes the series of indentations 46, as integral components of the first and second elements 10,20, these components may be formed separately and then attached to the corresponding elements.

Alternatively, the protuberances 42 may be formed on the lower surface 24 of the second element 20 with the indentations 46 formed on the first element 10. Also, the protuberances 42 and indentations 46 may be provided with alternate shapes, such as by forming the protuberances 42 as a sheet member having a plurality of ridges. Further, the positioning means alternatively may be formed as at least one indentation 46 provided on one of the first and second elements 10,20 and a series of protuberances 42 provided on the other of the first and second elements 10,20. Thus, the indentation 46 is configured to successively receive and engage each protuberance 42 as the second element 20 is rotated relative to the first element 10 to successively position the open outer end 56 of each compartment 50 in alignment with the outlet 16.

A tray member is positioned proximate to the outlet and extends radially outward from the peripheral sidewall of the first element, in accordance with the dispenser of the present invention. The tray member includes a retaining portion to receive and retain the contents dispensed through the outlet from the selected one compartment that is moved into alignment with the outlet. FIGS. 4 and 5 show that the retaining portion 64 is preferably provided by forming a recess on an upper surface 62 of the tray member 60, although a raised lip may likewise be used. The retaining portion 64 of the tray member 60 should be sufficiently dimensioned to capture the contents dispensed through the outlet 16, and permit the operator to retrieve the dispensed contents. By providing the retaining portion 64 with a curved or sloped inner surface, retrieval of the dispensed contents may be further simplified.

In the preferred embodiment of the dispenser 100, and as best seen in FIGS. 4 and 5, the tray member 60 is integrally formed with the first element 10 as a single piece. However, the tray member 60 likewise may be fabricated as a separate piece, and then attached to the first element 10, either permanently, e.g., by fusion or adhesion, or removably, e.g., by fasteners or snap-fit connections. If the tray member 60 is fabricated separately, the same material and method of fabrication that is used for the first element 10 would be preferred for fabrication of the tray member 60, although alternative materials and methods may be used if desired.

To protect the contents contained within the compartments and prevent inadvertent or undesired removal of the contents, and further in accordance with the present invention, the dispenser also includes a cover member. The cover member is attached to the second element so as to be movable between a closed position that substantially closes the open tops of the compartments and an open position that allows access to the compartments through the open tops for loading of the contents therein. As seen in FIGS. 4 and 5, and as embodied herein, the cover member 70 is attached to the second element 20 by at least one hinge 75 for movement between the closed position and the open position.

The exemplary embodiment of the dispenser 100 presented herein includes two hinges 75 between the cover member 70 and the second element 20. Specifically, the cover member 70 has an arcuate shape that is sized to correspond to the open tops 58 of the compartments 50. A pin member 76 extends radially inward from opposite ends of the cover member 70. Each pin member 76 is received by a corresponding hinge connection 78 provided on the upper surface 22 of the second element 20. To simplify assembly, one hinge connection 78 of the exemplary embodiment is a raised member having a through hole for receiving one pin member 76, while the other hinge connection 78 is an inverted L-shaped member configured to engage the other pin member 76. The one pin member 76 is first longitudinally inserted into the through hole of the raised member, and the other pin member 76 is then laterally urged into engagement with the L-shaped member. Alternate hinge 75 configurations likewise may be used, such as a single hinge 75 connecting the center of the cover member 70 to the second element 20.

The cover member 70 has a curved outer edge 72 having a diameter that is at least equivalent to the diameter of the cavity 18. This ensures that the contents of each compartment 50 remains protected when the cover member 70 is in the closed position. In the exemplary embodiment, and as seen in FIGS. 1, 2, and 4, the outer edge 72 of the cover member 70 is coextensive with the peripheral sidewall 14, and a depending tab member 73 is provided on the curved outer edge 72 to facilitate opening and closing of the cover member 70. The tab member 73 overlaps the upper edge of the peripheral sidewall 14 of the first element 10, so as to travel along the upper edge as the second element 20 is rotated relative to the first element 10. Further, a ridge (not shown) may be provided along the upper edge of the peripheral sidewall 14 and a corresponding groove may be provided transversely across the inner surface of the tab member 73 to receive the ridge. In this manner, the tab member 73 locks or holds the cover member 70 in the closed position to prevent inadvertent exposure or removal of the contents contained within the compartments 50, but still permits uninhibited rotation of the second element 20 relative to the first element 10.

The cover member 70 is preferably fabricated from a plastic material by injection molding, although an alternative material or method may be used. In the preferred embodiment of the present invention, the cover member 70 is transparent for visibility of the contents contained within the compartments 50 when the cover member 70 is in the closed position. Hence, the contents of the dispenser 100 can be inspected without requiring opening of the cover member 70, and unnecessary exposure of the contents.

To further enhance the operation of the dispenser 100, the cover member 70 is preferably marked with indicia 79 identifying each of the compartments 50. Likewise, it is preferred that the second element 20 is also mared with similar indicia 29 identifying each of the compartments 50. For example, the number of compartments 50 in the exemplary embodiment of the present invention is seven, and each of the indicia 29,79 identifies a different day of the week for each compartment 50. The number of compartments likewise may be twenty-four, wherein each of the indicia 29,79 identifies a different hour of the day. By providing indicia 29,79 on both the cover member 70 and the second element 20, verification that each compartment 50 is properly loaded may be performed regardless of the position of the cover member 70. That is, verification may be performed during loading when the cover member 70 is in the open position, and after loading when the cover member 70 is in the closed position. This is particularly useful when the contents of each compartment 50 must be varied, e.g., medications that are only required on specific days of the week. Alternatively, indicia may be provided on only one of either the cover member 70 or the second element 20.

The dispenser 100 embodied herein also includes a bottle holder on one of the first and second elements 10,20. As depicted in FIGS. 1 and 4, the bottle holders may be provided in a variety of locations and sizes. For example, FIGS. 1 and 4 show a bottle holder including a recess 82 provided approximately in the center of the upper surface 22 of the second element 20 for receiving and holding a bottle of a predetermined size. The bottle holder further includes a second recess 84 within the first recess 82, wherein the second recess 84 is smaller than the first recess 82 for holding a bottle smaller in size than the first recess 82. That is, the second recess 84 substantially forms a shoulder 83 within the first recess 82 upon which a larger bottle can be supported. In the preferred embodiment of the present invention, the first recess 82 has a diameter of about 2 inches and a depth of ¾ inches, while the second recess 84 has a diameter of about 1¼ inches and an additional depth beyond the first recess 82 of about ¼ inches.

Additional recesses also may be provided at eccentric locations on the upper surface 22 of the second element 20, as depicted in FIGS. 1 and 4. These eccentrically-located recesses 85 may be used for holding additional bottles on the upper surface 22 of the second element 20, or these eccentrically-located recesses 85 may operate as means for facilitating rotation of the second element 20 relative to the first element 10. That is, rotation is facilitated by inserting either a finger or a hand-held object into the eccentrically-located recess 85 to more effectively generate a torque on the second element 20 relative to the first element 10.

Alternatively, the means for facilitating rotation of the second element 20 may include a tab or similar appendage fixed to the second element 20 upon which a torque may be generated. Likewise, the bottle holders that are included on the dispenser 100 of the present invention are not limited to recesses of circular shape that are formed in the upper surface 22 of the second element 20. Bottle holders also may include raised edges or clips configured to engage the sides of a bottle, or recesses that are rectangular in shape to hold similarly shaped bottles. Further, bottle holders may be located along the peripheral sidewall 14 of the first element 10.

The versatility of the dispenser 100 is even further enhanced by providing a sheet holder 86 on either the first element 10 or the second element 20. As depicted in FIGS. 1 and 4, the sheet holder 86 of the exemplary embodiment includes an elongate slot or recess formed in the upper surface 22 of the second element 20. The sheet holder 86 may be used for holding prescriptions, dosage information and schedules, or note pads. Likewise, FIGS. 1 and 4 show that a shallow recess 88 also may be formed in the upper surface 22 of the second element 20 for holding writing utensils or other miscellaneous objects.

In summary, and with reference to the exemplary embodiment of the present invention, the dispenser 100 is generally fabricated as three separate pieces, i.e., the first element 10, the second element 20, and the cover member 70. These three pieces easily snap together without the need for additional fasteners or tools. Once assembled, the dispenser 100 is both durable and light weight. To operate the dispenser 100, the transparent cover member 70 is first moved to the open position, and the desired contents are loaded into the appropriate compartments 50. Indicia 29,79 identify the compartments 50 to ensure proper loading. Once loaded, the transparent cover member 70 is moved back to the closed position. To selectively dispense the contents of a desired compartment 50, the second member is simply rotated relative to the first element 10 until the desired compartment 50 is aligned with the outlet 16 so that the contents of the desired compartment 50 are dispensed onto and retained by the retaining portion 64 of the tray member 60. Hence, it is evident that the dispenser 100 of the present invention is inexpensive to fabricate, and easy to use.

It will be apparent to those skilled in the art that various modifications and variations can be made in the design and fabrication of the dispenser of the present invention without departing from the scope or spirit of the invention.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. A dispenser for selectively dispensing contents loaded therein, the dispenser comprising:

a first element including a base portion and a peripheral sidewall extending from the base portion to define a cavity within the first element, the peripheral sidewall having an outlet formed therethrough;

a second element mounted within the cavity to be rotatable relative to the first element, the second element having a lower surface and an upper surface, the second element further having a number of compartments provided along a peripheral portion of the upper surface, each compartment including a pair of side walls and a bottom wall, each compartment further including an open outer end facing the peripheral sidewall so the contents loaded within the dispenser are contained within the compartments by the peripheral sidewall;

a tray member positioned proximate to the outlet and extending radially outward from the peripheral sidewall, the tray member having a retaining portion, wherein rotation of the second element relative to the first element aligns the open outer end of a selected one of the compartments with the outlet to permit the contents contained within the selected one compartment to be dispensed onto and retained by the retaining portion of the tray member; and positioning means for successively indexing the open outer end of each of the compartments in alignment with the outlet as the second element is rotated relative to the first element, the positioning means including a protuberance provided on one of the first and second elements and a series of indentations provided on the other of the first and second elements, the series of indentations configured to successively receive and engage the protuberance as the second element is rotated relative to the first element to successively position the open outer end of each compartment in alignment with the outlet.

2. The dispenser of claim 1, wherein the retaining portion of the tray member is a recess formed on an upper surface of the tray member.

3. The dispenser of claim 1, wherein the bottom wall of each compartment is sloped to slide the contents contained therein outwardly toward the peripheral sidewall.

4. The dispenser of claim 1, wherein the base portion of the first element is provided with a friction member to prevent the dispenser from inadvertently slipping when placed on a support surface.

5. The dispenser of claim 1, wherein the second element is marked with indicia identifying each of the compartments.

6. The dispenser of claim 1 further including means for facilitating rotation of the second element relative to the first element.

7. The dispenser of claim 1, wherein each compartment has an open top, the dispenser further comprising a cover member attached to the second element, the cover member being movable between a closed position that substantially closes the open tops of the compartments and an open position that allows access to the compartments through the open tops for loading of the contents therein.

8. A dispenser for selectively dispensing contents loaded therein, the dispenser comprising:

a first element including a base portion and a peripheral sidewall extending from the base portion to define a cavity within the first element, the peripheral sidewall having an outlet formed therethrough;

a second element mounted within the cavity to be rotatable relative to the first element, the second element having a lower surface and an upper surface, the second element further having a number of compartments provided along a peripheral portion of the upper surface, each compartment including a pair of side walls and a bottom wall, each compartment further including an open outer end facing the peripheral sidewall so the contents loaded within the dispenser are contained within the compartments by the peripheral sidewall;

a tray member positioned proximate to the outlet and extending radially outward from the peripheral sidewall, the tray member having a retaining portion, wherein rotation of the second element relative to the first element aligns the open outer end of a selected one of the compartments with the outlet to permit the contents contained within the selected one compartment to be dispensed onto and retained by the retaining portion of the tray member; and at least one bottle holder provided on one of the first and second elements.

9. The dispenser of claim 8, wherein the bottle holder includes a recess provided in the upper surface of the second element for supporting a bottle therein.

10. The dispenser of claim 9, wherein the bottle holder further includes a second recess within the first recess, the second recess being smaller than the first recess for holding a bottle smaller in size than the first recess.

11. A dispenser for selectively dispensing contents loaded therein, the dispenser comprising:

a first element including a base portion and a peripheral sidewall extending from the base portion to define a cavity within the first element, the peripheral sidewall having an outlet formed therethrough;

a second element mounted within the cavity to be rotatable relative to the first element, the second element having a lower surface and an upper surface, the second element further having a number of compartments provided along a peripheral portion of the upper surface, each compartment including a pair of side walls and a bottom wall, each compartment further including an open top and an open outer end facing the peripheral sidewall so the contents loaded within the dispenser are contained with the compartments by the peripheral sidewall, wherein rotation of the second element relative to the first element aligns the open outer end of a selected one of the compartments with the bullet to permit the contents contained within the selected one compartment to be dispensed through the outlet; and a cover member attached to the second element, the cover member being movable between a closed position that substantially closes the open tops of the compartments and an open position that allows access to the compartments through the open tops for loading of the contents therein, wherein the cover member is attached to the second element by at least one hinge for movement between the closed position and the open position.

12. The dispenser of claim 11, wherein the cavity has a circular shape and the cover member has an arcuate shape sized to correspond to the open tops of the compartments, the cover member including a curved outer edge having a diameter at least equivalent the diameter of the cavity.

13. The dispenser of claim 11, wherein the cover member is transparent for visibility of the contents contained within the compartments when the cover member is in the closed position.

14. The dispenser of claim 11, wherein the cover member is marked with indicia identifying each of the compartments.

15. The dispenser of claim 14, wherein the number of compartments is seven and each of the indicia identifies a different day of the week.

16. The dispenser of claim 14, wherein the second element is marked with indicia identifying each of the compartments.

17. The dispenser of claim 11, wherein the bottom wall of each compartment is sloped to slide the contents contained therein outwardly toward the peripheral sidewall.

18. The dispenser of claim 11 further including a tray member positioned proximate to the outlet and extending radially outward from the peripheral sidewall, the tray member having a retaining portion for receiving and retaining the contents dispensed through the outlet.

19. The dispenser of claim 11 further including positioning means for successively indexing the open outer end of each of the compartments in alignment with the outlet as the second element is rotated relative to the first element.

20. A dispenser for selectively dispensing contents loaded therein, the dispenser comprising:

a first element including a base portion and a peripheral sidewall extending from the base portion to define a cavity within the first element, the peripheral sidewall having an outlet formed therethrough;

a second element mounted with the cavity to be rotatable relative to the first element, the second element having a lower surface and an upper surface, the second element further having a number of compartments provided along a peripheral portion of the upper surface, each compartment including a pair of side walls and a bottom wall, each compartment further including an open outer end facing the peripheral sidewall so the contents loaded within the dispenser are contained within the compartments by the peripheral sidewall;

a tray member positioned proximate to the outlet and extending radially outward from the peripheral sidewall, the tray member having a retaining portion, wherein rotation of the second element relative to the first element aligns the open outer end of a selected one of the compartments with the outlet to permit the contents contained within the selected one compartment to be dispensed onto and retained by the retaining portion of the tray member; and positioning means for successively indexing the open outer end of each of the compartments in alignment with the outlet as the second element is rotated relative to the first element, the positioning means including an indentation provided on one of the first and second elements and a series of protuberances provided on the other of the first and second elements, the indentation configured to successively receive and engage each protuberance as the second element is rotated relative to the first element to successively position the open outer end of each compartment in alignment with the outlet.

21. A dispenser for selectively dispensing contents loaded therein, the dispenser comprising:

a first element including a base portion and a peripheral sidewall extending from the base portion to define a cavity within the first element, the peripheral sidewall having an outlet formed therethrough;

a second element mounted within the cavity to be rotatable relative to the first element, the second element having a lower surface and an upper surface, the second element further having a number of compartments provided along a peripheral portion of the upper surface, each compartment including a pair of side walls and a bottom wall, each compartment further including an open outer end facing the peripheral sidewall so the contents loaded within the dispenser are contained within the compartments by the peripheral sidewall;

a tray member positioned proximate to the outlet and extending radially outward from the peripheral sidewall, the tray member having a retaining portion, wherein rotation of the second element relative to the first element aligns the open outer end of a selected one of the compartments with the outlet to permit the contents contained within the selected one compartment to be dispensed onto and retained by the retaining portion of the tray member; and a sheet holder on one of the first and second elements for holding sheets of recording material.

* * * * *

UNITED STATES PATENT AND TRADEMARK OFFICE

CERTIFICATE OF CORRECTION

PATENT NO. : 5,477,981

DATED : December 26, 1995

INVENTOR(S) : HEYL et al.

It is certified that error appears in the above-indentified patent and that said Letters Patent is hereby corrected as shown below:

Claim 11, column 12, line 45 change "bullet" to --outlet--.

Signed and Sealed this

Twenty-third Day of April, 1996

*Attest:*

BRUCE LEHMAN

*Attesting Officer*

*Commissioner of Patents and Trademarks*